US005983877A

United States Patent [19]

Madugula et al.

[11] Patent Number: 5,983,877

[45] Date of Patent: Nov. 16, 1999

[54] APPARATUS AND A METHOD FOR ADJUSTING THE AIR FUEL RATIO OF AN INTERNAL COMBUSTION ENGINE

[75] Inventors: Rama Madugula, Troy; Ken Hardman, Clarkston, both of Mich.

[73] Assignee: Chrysler Corporation, Auburn Hills, Mich.

[21] Appl. No.: 09/050,515

[22] Filed: Mar. 30, 1998

[51] Int. Cl.[6] ..... F02D 41/14

[52] U.S. Cl. ..... 123/681; 123/687; 701/109

[58] Field of Search ..... 123/679, 681, 123/682, 684, 687; 701/109; 60/276, 274

[56] References Cited

U.S. PATENT DOCUMENTS

| | | | |
|---|---|---|---|
| 3,935,851 | 2/1976 | Wright et al. | 123/139 E |
| 3,992,940 | 11/1976 | Platzer, Jr. | 73/204 |
| 4,048,964 | 9/1977 | Kissel | 123/32 ED |
| 4,102,314 | 7/1978 | Sarto | 123/119 B |
| 4,125,093 | 11/1978 | Platzer, Jr. | 123/32 EA |
| 4,205,648 | 6/1980 | Graham | 123/139 AN |
| 4,252,098 | 2/1981 | Tomczak et al. | 123/437 |
| 4,277,772 | 7/1981 | Kastura et al. | 340/52 F |
| 4,452,211 | 6/1984 | Wataya | 123/492 |
| 4,554,902 | 11/1985 | Atkins | 123/557 |
| 4,633,403 | 12/1986 | Asmus | 364/431.05 |
| 4,821,701 | 4/1989 | Nankee, II et al. | 123/520 |
| 5,255,661 | 10/1993 | Nankee, II et al. | 123/674 |
| 5,400,758 | 3/1995 | Rader et al. | 123/494 |
| 5,467,593 | 11/1995 | Vincent et al. | 60/274 |
| 5,497,753 | 3/1996 | Kopera | 123/494 |
| 5,584,277 | 12/1996 | Chen et al. | 123/480 |
| 5,635,621 | 6/1997 | Lawson | 73/1.73 |
| 5,638,800 | 6/1997 | Furuya et al. | 123/674 |
| 5,787,868 | 8/1998 | Maki et al. | 123/681 |
| 5,893,039 | 4/1999 | Pfefferle | 701/103 |

*Primary Examiner*—Tony M. Argenbright
*Assistant Examiner*—Arnold Castro
*Attorney, Agent, or Firm*—Mark P. Calcaterra

[57] ABSTRACT

The present invention overcomes these problems by providing an oxygen sensor located in the exhaust stream of an internal combustion engine, a load sensing device which generates a signal indicative of an internal combustion engine load, a central processing unit which calculates a running average of the oxygen content in the exhaust stream indicated by the oxygen sensor and a fuel injection device which supplies fuel to the combustion air in response to the central processing unit. The central processing unit uses the running average of the oxygen content in the exhaust stream, in lieu of the instantaneous oxygen content, to modify the fuel equation for determining the proper air fuel mix when transitioning from closed to open loop operation. The resulting air fuel mixture thus reflects the average oxygen value in the exhaust over a period of time. This average serves to cancel out the extreme surplus and deficiency of oxygen in the exhaust stream due to dithering.

9 Claims, 3 Drawing Sheets

APPARATUS AND A METHOD FOR ADJUSTING THE AIR FUEL RATIO OF AN INTERNAL COMBUSTION ENGINE

I. TECHNICAL FIELD

The present invention relates generally to adjusting an air fuel mixture of an internal combustion engine and, more particularly, to adjusting the air fuel mixture of an internal combustion engine based on a running average of the oxygen content of an exhaust stream of the internal combustion engine.

II. DISCUSSION

In the operation of internal combustion engines, it has become increasingly important to operate the internal combustion engine as fuel efficiently as possible. However, if the air-fuel mixture supplied to the engine at high load is not rich enough, damage to the engine may result. Hence, various devices and methods have been developed to monitor the combustion exhaust gases to determine if too much or too little fuel is being supplied to the engine for a given set of operating conditions. By analyzing the oxygen content in an exhaust stream which is generated by the engine, one can determine if the proper amount of fuel is being supplied. If too much fuel is being supplied, there exists a lack of free oxygen in the exhaust stream. Likewise, if too little fuel is being supplied, there exists a surplus of oxygen in the exhaust stream. A conventional oxygen sensor used in an automotive exhaust stream indicates if the mixture is rich or lean. The oxygen sensor signal is used to switch the fuel-air between rich and lean so that the average fuel/air is nearly stoichiometric.

When too much fuel is added to an engine under a given set of engine operating conditions, poor fuel economy results. When too little fuel is provided under a given set of conditions, the engine temperature rises which may result in severe damage to the engine's components. As a result, conventional internal combustion engines are fitted with oxygen sensors, located in the exhaust stream, to ensure that the proper air fuel mixture is provided for a given set of operating conditions.

However, oxygen sensors are only effective for determining the proper air fuel mixture when the internal combustion engine is operating near stoichiometry, i.e. the chemically correct air-fuel ratio for complete combustion. Under high speed-high load conditions, engine material temperature durability limits may be exceeded if the air-fuel ratio is stoichiometric. Thus, fuel enrichment is used as a coolant to limit the temperature of critical engine components. Under enriched operation, the fuel control system does not use oxygen sensor feedback and therefore runs open loop. This stoichiometric equation is the chemical equation that supplies complete combustion under a given engine speed, torque, temperature, and other operating conditions. Such equations and methods are well known in the art. This equation is further modified based on the last sensed oxygen content of the exhaust stream. Such methods, as that discussed above are well known in the art.

The use of the last sensed oxygen signal, as discussed above, sometimes presents problems. Vehicle engines are required by law to have catalytic converters for removing pollutants from the exhaust stream. The catalytic converter is placed in the exhaust stream and filters out pollutants. To ensure that the converter operates properly, it must be cyclically inundated with an oxygen rich (fuel lean) and an oxygen lean (fuel rich) exhaust stream. This cyclical inundation is accomplished by cyclically providing the engine with a rich and then lean air fuel mixture. Thus, when the oxygen sensor in the exhaust stream senses an oxygen rich environment, it instructs a central processing unit to cause a fuel injection device to add more fuel. Likewise, when the oxygen sensor senses an oxygen depleted environment, it instructs the central processing unit to cause a fuel injection device to reduce the amount of fuel being added to the engine. As a result, the oxygen content dithers back and forth ensuring that the catalytic converter is cyclically flushed with oxygen.

When the vehicle engine transitions from stoichiometric, closed loop $O_2$ sensor feedback operation to open loop, rich operation due to an increase in engine load or speed, the fuel correction multiplier based on the oxygen signal representing the oxygen content in the exhaust stream is frozen. That frozen value is used to modify the fuel equation for the given set of conditions (as discussed above fuel equation calculates stoichiometric fuel requirement when running closed loop, but if open loop, the fuel equation calculates fuel flow requirements as richer than stoichiometric). Because the oxygen content dithers due to the catalytic converter, the oxygen sensor may be reading an oxygen content which is either too rich or too lean. Therefore, the sensed oxygen value might not reflect the actual oxygen value resulting from a proper air fuel mixture at the current operating conditions of the internal combustion engine. As a result, the oxygen signal may cause over compensation or under compensation in fueling. The present invention was developed in light of these drawbacks.

SUMMARY OF THE INVENTION

The present invention overcomes these problems by modifying the fuel equation by an averaged oxygen value when the internal combustion engine transitions from a closed loop fuel control to open loop fuel control. The present invention provides an oxygen sensor located in the exhaust stream of an internal combustion engine, a load sensing device (Manifold Absolute pressure sensor), a speed sensing device, a central processing unit which calculates a running average of the oxygen content in the exhaust stream indicated by the oxygen sensor, and a fuel injection device which supplies fuel to the combustion air in response to the central processing unit. The central processing unit uses the running average of the oxygen content in the exhaust stream, in lieu of the instantaneous oxygen content, to modify the fuel equation for predicting the proper air fuel mixture. The resulting air fuel mixture thus reflects the average oxygen value in the exhaust over a period of time. This average serves to cancel out the extreme surplus and deficiency of oxygen in the exhaust stream due to dithering.

In a second aspect of the present invention, a method is disclosed for adjusting air fuel mixture of an internal combustion engine which has transitioned from a closed loop to open loop operation. This method involves sensing the amount of free oxygen in an exhaust stream generated by the internal combustion engine in closed loop operation, calculating a running average of the correction factor necessary to maintain stoichiometric operation, and adjusting the air fuel mixture based on this running average when the internal combustion engine transitions from closed loop to open loop.

Additional advantages and features of the present invention will become apparent from the subsequent description and the appended claims taken in conjunction with the accompanying drawings.

BRIEF DESCRIPTION OF THE DRAWINGS

In the drawings which illustrate the best mode presently contemplated for carrying out the present invention.

DETAILED DESCRIPTION OF THE PREFERRED EMBODIMENTS

Figure 1:
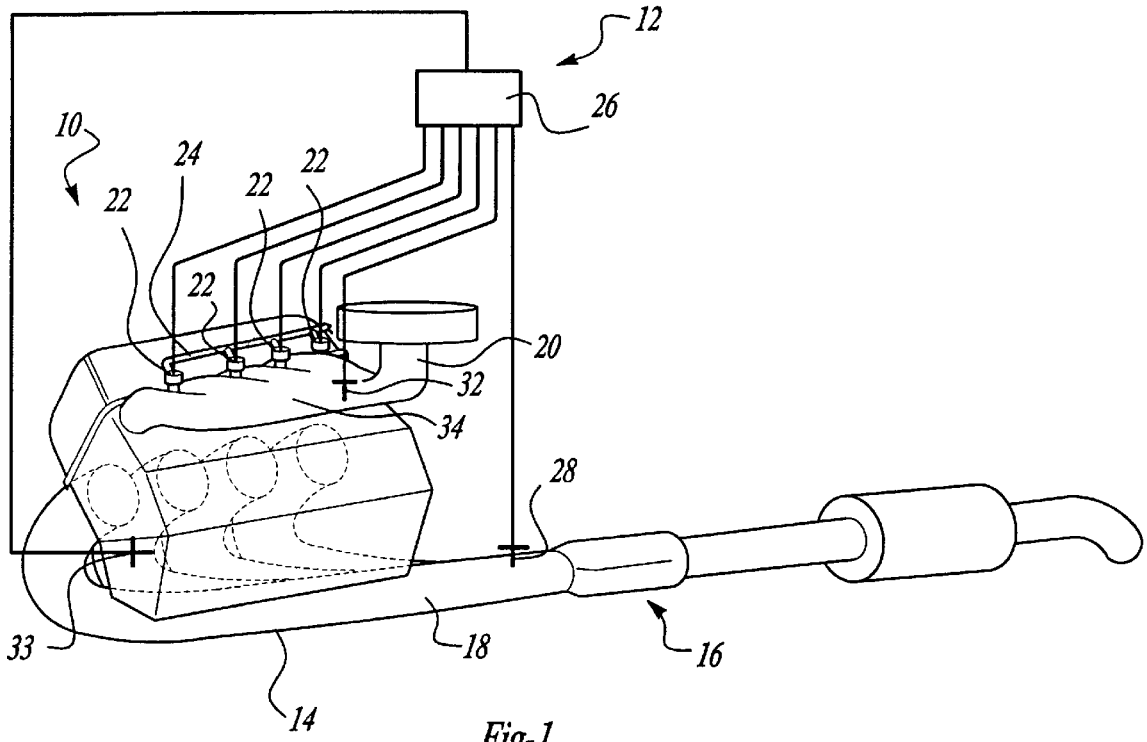
FIG. 1 is a perspective view of an internal combustion engine with an apparatus for adjusting the air fuel ratio according to the present invention.

With reference to FIG. 1, the general application of the present application can be seen. In FIG. 1, a four cylinder internal combustion engine 10 is shown with an apparatus 12 for modifying the air fuel mixture of the internal combustion engine 10. Internal combustion engine 10 has exhaust system 14 for allowing the exhaust stream 18 containing the by-products of combustion to exit behind a motor vehicle. Exhaust system 14 is attached to catalytic converter 16 for removing pollutants from exhaust stream 18.

Air intake manifold 20 is rigidly attached to internal combustion engine 10 for feeding combustion air therein. Fuel injectors 22 feed fuel from fuel rail 24 into intake manifold 20.

Central processing unit 26 electrically communicates with fuel injectors 22 for providing fuel into air stream 34. Oxygen sensor 28 protrudes through exhaust system 14 and into exhaust stream 18. Oxygen sensor 28 electrically communicates with central processing unit 26. Manifold air pressure sensor 32 protrudes through air intake manifold 20 and into air stream 34.

Figure 2:
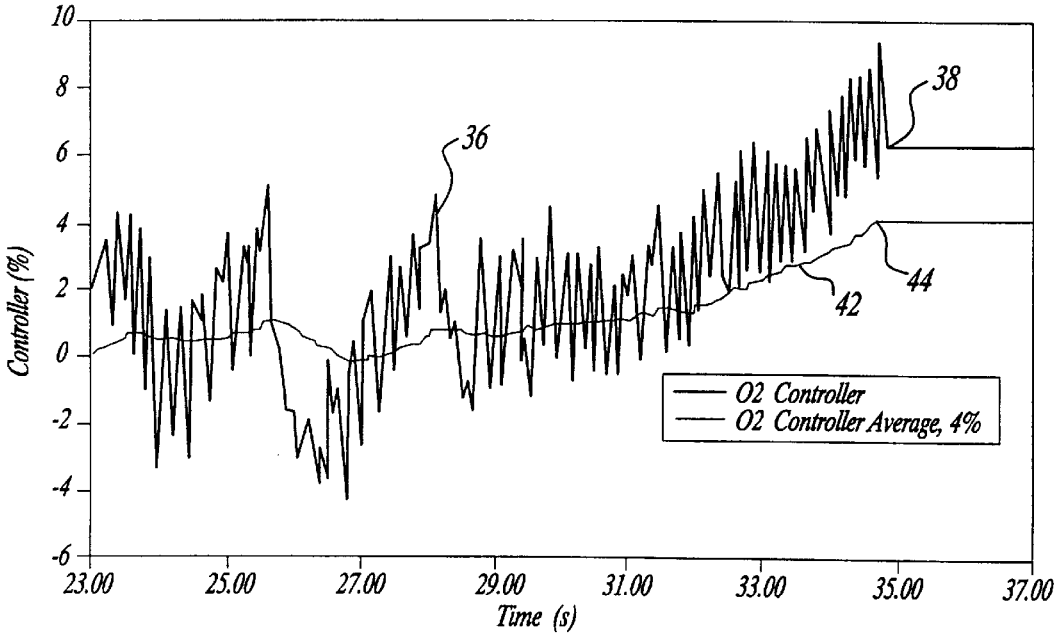
FIG. 2 is a graph showing the O2 instantaneous controller signal and the 02 controller average for an internal combustion engine having an apparatus for adjusting the air fuel ratio according to the present invention.
Figure 3:
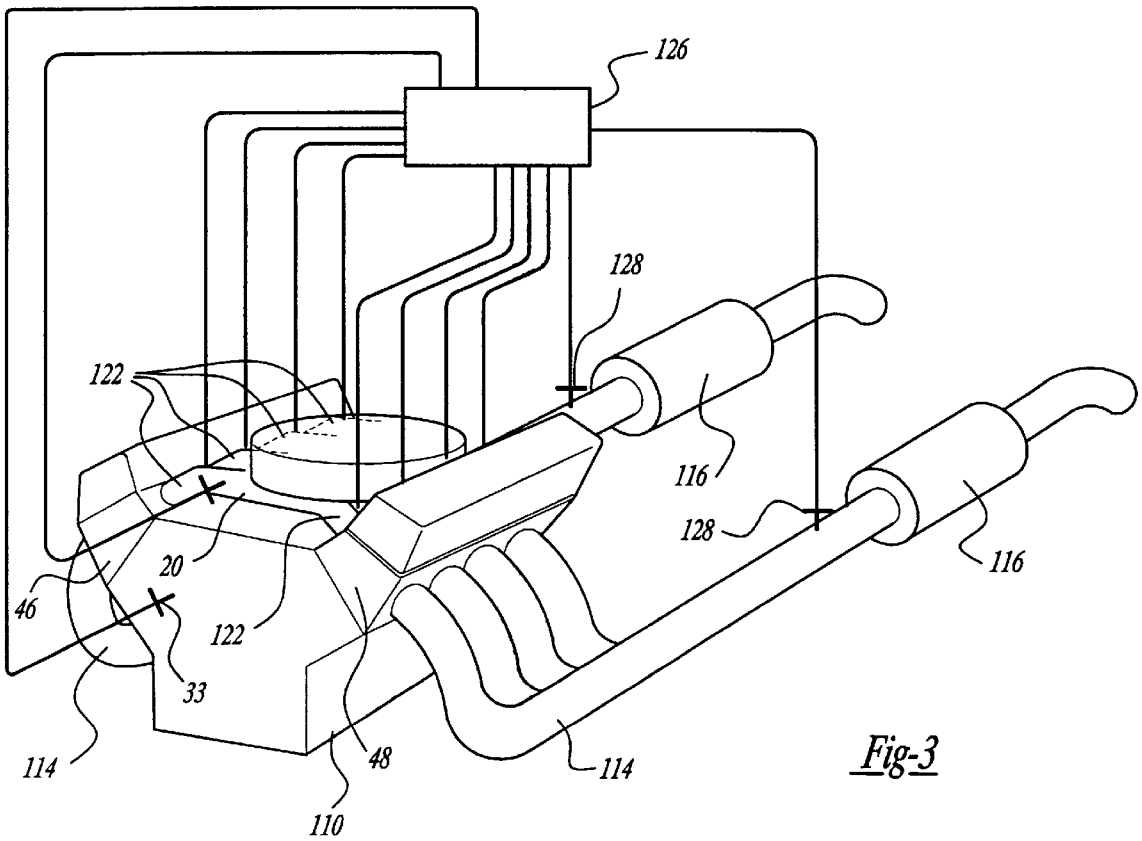
FIG. 3 is a perspective view of an internal combustion engine with two portions and an apparatus for adjusting the air fuel ration according to the present invention.

With reference to FIGS. 1, 2, and 3, the present invention will now be described. Referring to FIG. 1, when the internal combustion engine 10 is initially started, the engine is operating under what are known as open loop conditions. Under open loop conditions, central processing unit 26 controls the rate at which fuel injectors 22 inject fuel based on a stoichiometric equation. The stoichiometric equation is a chemical equation which provides the proper amount of fuel needed to be mixed with air to provide complete combustion in an internal combustion engine. The central processing unit 26 uses the equation to generate a fuel value representative of the required fuel to be injected by fuel injectors 22 for complete combustion. Such equations and their application to the internal combustion field are well known. Central processing unit 26 further modifies the stoichiometric equation by multiplying the fuel value by a figure representative of engine coolant temperature generated by an engine coolant sensor (not shown) and manifold pressure based on manifold pressure sensor 32. It is noted that central processing unit 26 modifies the resulting value of the stoichiometric equation based on engine conditions not limited to those disclosed herein, and those conditions are hereinafter referred to as operating conditions.

When the $0_2$ sensor is warm enough, internal combustion engine 10 enters what is known as a closed loop condition. In a closed loop condition, central processing unit 26 reads the oxygen content of exhaust stream 18 in exhaust system 14 upstream of catalytic converter 16. Based on the amount of free oxygen in exhaust stream 18, central processing unit 26 further modifies the amount of fuel injected into air stream 34 by fuel injectors 22 to ensure that complete combustion occurs. An excess of oxygen in exhaust stream 18 is indicative of too little fuel being injected by fuel injectors 22. Likewise, too little oxygen in exhaust stream 18 is indicative of too much fuel being injected by fuel injectors 22. If too little fuel is being used by internal combustion engine 10, the temperature of internal combustion engine 10 raises and can result in damage to its components. If too much fuel is being injected by fuel injectors 22, internal combustion engine 10 uses more fuel than it needs which results in poor fuel economy.

Catalytic converter 16 removes pollutants and toxins from exhaust stream 18. Catalytic converter 16 must be cyclically flushed with oxygen from exhaust stream 18 in order to ensure longevity and proper operation. To ensure catalytic converter 16 is cyclically flushed with oxygen, central processing unit 26 dithers the amount of fuel injected by fuel injectors 22 such that oxygen sensor 28 cyclically senses an excess and deficit of oxygen in exhaust stream 18.

In FIG. 2, the instantaneous dithered oxygen value 36 of exhaust stream 18, as seen by oxygen sensor 28, is illustrated per unit time for internal combustion engine 10 in a closed loop condition. As is illustrated, central processing unit 26 cycles the fuel injected into internal combustion engine 10 by fuel injectors 22 such that oxygen sensor 28 sees a cycling oxygen content in exhaust stream 18. As a result, catalytic converter 16, located downstream from oxygen sensor 28, is cyclically inundated and then deprived of oxygen. In this way, the performance and longevity of catalytic converter 16 is maximized.

When internal combustion engine 10 is required to increase output speed or torque, such that temperatures would be too high if operating stoichiometrically, internal combustion engine 10 enters back into an open loop condition. Central processing unit 26 is required once again to predict the amount of fuel required from fuel injectors 22 by using the stoichiometric equation without the assistance of feedback information from oxygen sensor 28. The oxygen sensor's inability to be used as a fuel requirement predictor is due to its inability to read the richness of the mixture.

Current technology uses the last sensed frozen dithered oxygen value 38 (in FIG. 2) to modify the stoichiometric equation used to predict the fuel requirements of an internal combustion engine 10 undergoing a transition from closed to open loop conditions. Depending on whether the oxygen sensor 28 is sensing an oxygen rich or oxygen lean content of exhaust stream 18 due to dithering, the central processing unit 26 may over compensate or under compensate the engine fuel requirements based on the frozen dithered oxygen value 38.

In the present invention, central processing unit 26 more accurately predicts the oxygen value of exhaust stream 18 by maintaining a running average 42 of sensed instantaneous dithered oxygen value 36 of exhaust stream 18. Thus, when internal combustion engine 10 transitions from closed loop to open loop conditions due to increased load or speed requirements, central processing unit 26 uses the frozen running average 44 instead of the frozen dithered oxygen value 38 to modify the fuel equation and better predict the needed fuel requirement from fuel injectors 22. Running average 42 serves to cancel out the high and low peaks of instantaneous dithered oxygen value 36 and thereby provide a more accurate oxygen content of exhaust stream 18 for the given operating conditions of internal combustion engine 10.

Central processing unit 26 determines that internal combustion engine 10 has a changed speed or torque requirement and has entered an open loop condition based on sensed intake manifold pressure by intake manifold pressure sensor 32 and engine speed sensor 33. Upon sensing a change in intake manifold pressure by sensor 32, central processing unit 26 determines that internal combustion engine 10 should no longer operate in closed loop conditions and should therefore operate in open loop conditions. Central processing unit 26 then freezes instantaneous dithered oxygen value 36 (shown in FIG. 2) and the signal representative of the running average 42 (shown in FIG. 2). Central processing unit 26 then uses frozen running average signal 44 to predict the required fuel from fuel injectors 22. Central processing unit 26 performs this function by adding the frozen running average 44 to the fuel being injected by fuel injectors 22. Thus, as shown in FIG. 2, frozen running average 44 would modify the fuel equation by adding 4% fuel to that already being injected by fuel injectors 22. If the frozen running average value 44 was zero or less than zero, then the central processing unit would not modify the fuel need predicted by central processing unit 26 and provided by fuel injectors 22.

When internal combustion engine 10 undergoes an increased velocity or torque requirement and thus transitions from a closed loop to a open loop condition, the internal combustion engine 10 will almost always require the same or an increased amount of fuel from fuel injectors 22. Therefore, if the frozen running average 44 is negative when this transition occurs, the central processing unit will instruct fuel injectors 22 not to modify stoichiometric fuel equation at all. This ensures that internal combustion engine 10 is not underfueled and thereby damaged due to overheating. It should be noted that this invention is not limited to using the running average to modify the stoichiometric equation when the speed or torque requirements are increased. This invention may be used when the requirements are reduced causing an acceleration in the negative direction.

Referring to FIG. 3, an internal combustion engine 110 is shown with two portions 46 and 48. Each portion 46 and 48 have independent exhaust systems 114, catalytic converter 116, fuel injectors 122, and oxygen sensors 128. One central processing unit 126 is provided to control the fuel flow into each portion. Each portion 46 and 48 have independent combustion chambers (not shown) for generating output speed and torque. Central processing unit 126 operates each portion as if it were an independent internal combustion engine as described previously. Therefore, if portion 48 transitions from a closed loop to an open loop condition, central processing unit 126 freezes the running average generated from oxygen sensor 128 in portion 48 and modifies the fuel flow from fuel injectors 122 of portion 48 accordingly. Likewise, if portion 46 transitions from a closed loop to an open loop condition, central processing unit 126 modifies the fuel flow from fuel injectors 122 of portion 46 based on the frozen running average of instantaneous values provided by oxygen sensor 128 of portion 46. As a result, each portion 46 and 48 operate independently of one another. The manifold air pressure sensor, here, is replaced with mass air flow sensor 132. Mass air flow sensor 132 determines if internal combustion engine 110 should transition from a closed loop to an open loop condition due to a high load based on a change of air flow through intake manifold 120. It should be noted that a mass air flow sensor, manifold pressure sensor, or any other device which determines load for an internal combustion engine 110 may be used.

Figure 4:
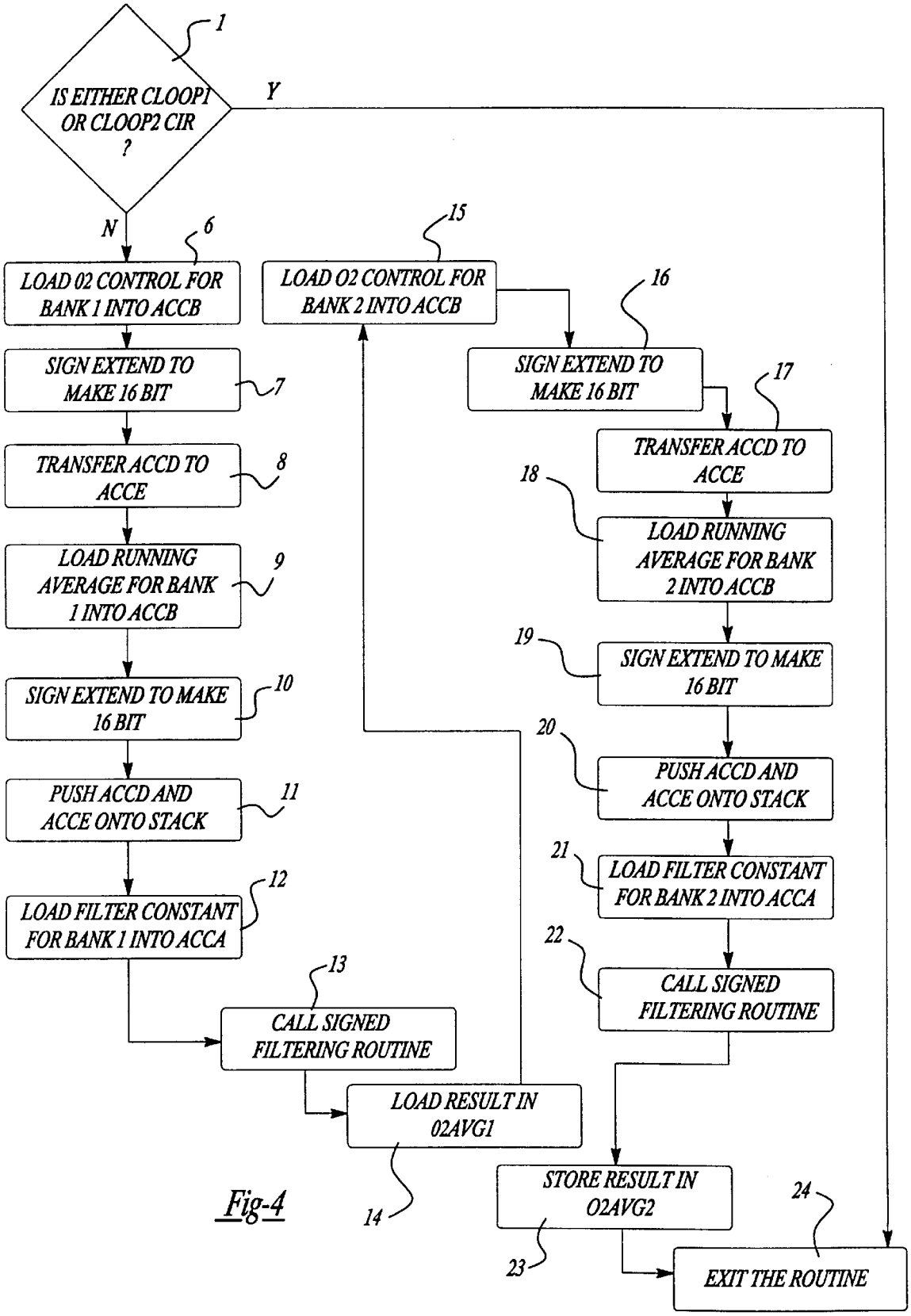
FIG. 4 is a flow chart which depicts the steps for calculating a running average of the oxygen content in an exhaust stream of an internal combustion engine according to the present invention.

With reference to FIG. 4, the algorithm for generating the running average 42 of internal combustion engine 110 in FIG. 3 is now described. In decision block 1, CLOOP 1, determines whether portion 46 is in a closed loop or open loop condition. Likewise, CLOOP 2 in decision block 1 determines whether portion 48 is in a closed loop or open loop condition. If either CLOOP 1 or CLOOP 2 determines that its respective portion of internal combustion engine 110 is in an open loop condition, the central processing unit 26 exits the subroutine for that portion. If block 1 determines that portion 46 is in a closed loop condition from CLOOP 1, then the algorithm proceeds to block 6. Block 6 loads the instantaneous dithered oxygen value 36 for portion 46 into an accumulator. After block 6 completes its loading, block 7 sign extends 8 bit accumulator B to 16 bit accumulator D. This allows the instantaneous oxygen value to retain its positive or negative sign. After this sign extension, block 8 transfers instantaneous oxygen value in accumulator D to accumulator E. After this processing, the current running average 42 (in FIG. 2) is loaded into accumulator B. As before, block 10 sign extends accumulator B to allow running average 42 to retain its positive or negative sign. Block 11 stacks accumulator D containing running average 42 and accumulator E which now contains the instantaneous dithered oxygen value 36 as stored in block 8. Block 12 loads a filter constant which ensures that the instantaneous oxygen value stored in accumulator E is given its proper weight. Thus, if 100 oxygen values are sampled over a period of time, the value in accumulator E is given a weighted factor of 1/100th. Block 13 generates the new filtered average which is stored in block 14 as O2AVG1. If CLOOP 2 determines that portion 48 is in a closed loop condition, the identical process repeats itself for portion 48 of internal combustion engine 110. This repeated process for portion 48 begins at block 15.

After the running average is calculated for portion 48, the central processing unit exits the subroutine of FIG. 4. Block 1 once again determines whether portion 46 or 48 is in closed or open loop conditions and repeats the above procedure. The subroutine is repeated until either portion 46 or 48 of internal combustion engine 110 enter an open loop condition. At that point, block 1 exits the subroutine of FIG. 4 and uses the frozen values 02AVG1 and 02AVG2 as stored in blocks 14 and 23. These averaged values are used to modify the stoichiometric equation used by central processing unit 126 to predict the fuel requirements of fuel injectors 22 under open loop conditions.

It is noted that since internal combustion engine 10 of FIG. 1 comprises one portion, the flow chart of FIG. 4 used to calculate running average 42 does not use blocks 15–23. Also, CLOOP 2 does not need to be used to determine whether the second portion is in an open or closed loop condition since internal combustion engine 10 contains no second portion. Outside of these variations, the algorithm of FIG. 5 operates for both internal combustion engine 10 and internal combustion engine 110.

While the above detailed description described preferred embodiment of the present invention, it should be understood that the present invention is susceptible to modification, variation, and alteration without deviating from the scope and fair meaning of the subadjoined claims.

We claim:

1. An apparatus for adjusting the air fuel ratio of an internal combustion engine, said apparatus comprising:

an oxygen sensor located in an exhaust stream of said internal combustion engine, said oxygen sensor generating an oxygen signal indicative of an amount of free oxygen in said exhaust stream;

a load sensing device generating a load signal indicative of said internal combustion engine load;

a speed sensing device generating a speed signal indicative of said internal combustion engine speed;

a central processing unit calculating a running average of values of said oxygen signals in a closed loop condition, said central processing unit freezing said running average to obtain a frozen running average when said internal combustion engine transitions from a closed loop to an open loop condition, said central processing unit generating a fuel signal based on said frozen running average when said load signal is indicative of said internal combustion engine transitioning from a closed loop condition to an open loop condition; and a fuel injection device fluidly communicating with an air steam supplying combustion air to said internal combustion engine, said fuel injection device adding fuel to said combustion air based on said fuel signal.

2. An apparatus as claimed in claim 1, wherein said load sensing device is a manifold air pressure sensor.

3. An apparatus as claimed in claim 1, wherein said load sensing device is a mass airflow sensor.

4. An apparatus as claimed in claim 1, wherein said fuel signal modified said fuel equation by adding a percent amount of fuel greater than or equal to zero and less than 25% of a current fuel value.

5. An apparatus as claimed in claim 1, further comprising a catalytic converter in said exhaust stream, said oxygen sensor being located along said exhaust stream between said internal combustion engine and said catalytic converter, said fuel injection device injecting fuel in a cyclical fashion into said air stream to enhance catalytic performance when said internal combustion engine is operating in a closed loop condition.

6. An apparatus as claimed in claim 1, wherein said internal combustion engine powers a motor vehicle.

7. A method for adjusting the air fuel mixture of an internal combustion engine which has transitioned from a closed loop to an open loop condition, said method comprising:

a) sensing the amount of free oxygen in an exhaust stream generated by said internal combustion engine in a closed loop condition;

b) calculating a running average of said amount of free oxygen while said internal combustion engine is in a closed loop condition;

c) freezing said running average to obtain a frozen running average when said internal combustion engine transitions from a closed loop to an open loop condition; and d) adjusting said air fuel mixture based on said running average when said internal combustion engine transitions from a closed loop condition to an open loop condition.

8. A method as claimed in claim 7, wherein step b) comprises the steps of:

a) loading an oxygen value representative of said amount of free oxygen into a first accumulator;

b) moving said oxygen value from said first accumulator to a second accumulator;

c) loading a running average of said amount of free oxygen into said first accumulator;

d) loading a filtering constant into a third accumulator;

e) calculating a new running average based on said oxygen value, said running average and said filtering constant with a filtering subroutine f) storing said new running average.

9. A method as claimed in claim 7, wherein said air fuel mixture is adjusted by the steps comprising:

multiplying a fuel equation by a figure proportional to said running average to generate a fuel signal; and adjusting said air fuel mixture proportional to said fuel signal.

* * * * *